US011083302B2

(12) United States Patent
Yan et al.

(10) Patent No.: US 11,083,302 B2
(45) Date of Patent: Aug. 10, 2021

(54) FOLDING LOCKING MECHANISM USED FOR STEP STOOL

(71) Applicant: Jiangsu Zhou Jijie Intelligent Technology Co., Ltd, Suqian (CN)

(72) Inventors: Heng Yan, Suqian (CN); Baisong Yao, Suqian (CN)

(73) Assignee: JIANGSU ZHOU JIJIE INTELLIGENT TECHNOLOGY CO., LTD., Suqian (CN)

( * ) Notice: Subject to any disclaimer, the term of this patent is extended or adjusted under 35 U.S.C. 154(b) by 284 days.

(21) Appl. No.: 16/299,092

(22) Filed: Mar. 11, 2019

(65) Prior Publication Data

US 2019/0387887 A1 Dec. 26, 2019

(30) Foreign Application Priority Data

Jun. 21, 2018 (CN) ..... 201820956007.4

(51) Int. Cl.
*A47C 12/00* (2006.01)
*E04G 7/34* (2006.01)
*E04G 1/34* (2006.01)

(52) U.S. Cl.
CPC ..... *A47C 12/00* (2013.01); *E04G 1/34* (2013.01); *E04G 7/34* (2013.01)

(58) Field of Classification Search
CPC .. A47C 12/00; E04G 1/28; E04G 1/34; E04G 7/34
See application file for complete search history.

(56) References Cited

U.S. PATENT DOCUMENTS

| | | | | | |
|---|---|---|---|---|---|
| 5,368,126 | A * | 11/1994 | Woodward | E04G 1/20 | 182/118 |
| 5,819,671 | A * | 10/1998 | Ocampo | B23D 47/025 | 108/64 |
| 6,289,824 | B1 * | 9/2001 | Parker | A47B 1/00 | 108/115 |
| 10,030,447 | B2 * | 7/2018 | Pyros | E04G 1/18 | |
| 10,435,894 | B2 * | 10/2019 | Woodward | E04G 1/30 | |
| 10,858,848 | B2 * | 12/2020 | Woodward | E04G 1/30 | |
| 2002/0178978 | A1 * | 12/2002 | Wang | B25H 1/04 | 108/133 |
| 2019/0226217 | A1 * | 7/2019 | Foley | E04G 1/30 | |

FOREIGN PATENT DOCUMENTS

| | | | | |
|---|---|---|---|---|
| CN | 2899603 | Y | 5/2007 | |
| CN | 106184139 | A * | 12/2016 | |
| EP | 2000612 | A2 * | 12/2008 | E04G 1/34 |
| WO | WO-2008119126 | A1 * | 10/2008 | E04G 1/34 |
| WO | WO-2019073255 | A1 * | 4/2019 | E04G 5/141 |

* cited by examiner

*Primary Examiner* — Alvin C Chin-Shue
(74) *Attorney, Agent, or Firm* — Bayramoglu Law Offices LLC

(57) ABSTRACT

A folding locking mechanism used for a step stool is disclosed. The step stool includes a stool plate, stool legs rotatably arranged on the stool plate and a locking mechanism used for locking the stool legs. The locking mechanism includes a first connecting piece and a pin, wherein the first connecting piece is fixedly connected with the stool plate and is provided with a limiting hole allowing the pin to fall therein, and the pin is limited in the radial direction and is movable in the axial direction, relative to the stool legs.

14 Claims, 9 Drawing Sheets

FOLDING LOCKING MECHANISM USED FOR STEP STOOL

CROSS REFERENCE TO RELATED APPLICATIONS

This application is based upon and claims priority to Chinese Patent Application No. 201820956007.4, filed on Jun. 21, 2018, the entire contents of which are incorporated herein by reference.

TECHNICAL FIELD

The invention relates to a folding locking mechanism used for a step stool, and belongs to the technical field of household articles.

BACKGROUND

Chinese Utility Model Patent Publication (Notification) No. CN2899603Y discloses a folding stool formed by a plurality of plates which are integrally hinged together, wherein a square stool which is firm in structure and high in bearing capacity is formed when the plates are completely unfolded, and a square block which occupies the smallest space and has a regular appearance is formed after the plates are folded. In this technical solution, the stool legs are hinged to the stool plate and thus can be folded relative to the stool plate; however, after being rotated in position, the stool legs cannot be locked, and consequentially, the safety in use is poor, and the folding stool is instable after being folded.

SUMMARY

The objective of the invention is to overcome the above defects of the prior art by providing a folding locking mechanism which is used for a step stool and is reasonable in structural design and beneficial to folding operation.

The technical solution adopted by the invention to fulfill the above objective is to provide a folding locking mechanism used for a step stool. The step stool includes a stool plate and stool legs, wherein the stool legs are rotatably arranged on the stool plate. The folding locking mechanism includes a first connecting piece and a pin, wherein the first connecting piece is fixedly connected to the stool plate and is provided with a limiting hole allowing the pin to fall therein, and the pin is limited in the radial direction and is movable in the axial direction, relative to the stool leg.

Furthermore, the folding locking mechanism further includes a second connecting piece fixedly connected to the stool leg, and the second connecting piece is rotatably connected to the first connecting piece.

Furthermore, the folding locking mechanism further includes an elastic piece, wherein the elastic piece is connected to the pin and applies a force towards the limiting hole to the pin.

Furthermore, a guide surface extending outwards is arranged on an outer edge of the first connecting piece.

Furthermore, the folding locking mechanism further includes a cross stopper used for assembling the pin, wherein the cross stopper is connected to the stool leg and is provided with two stop pieces, the stop pieces are provided with holes allowing the pin to penetrate through, a gap is reserved between the two stop pieces, and the elastic piece is arranged between the two stop pieces and has an end abutting against the stop pieces and an end abutting against a pin shaft on the pin.

Furthermore, the holes are provided with openings allowing the pin to penetrate through, and after the pin is assembled with the cross stopper and the pin shaft, the pin shaft is mismatched with the openings.

Furthermore, the folding locking mechanism further includes a spanner, wherein the spanner is provided with a first rotary connecting part and a second rotary connecting part, the first rotary connecting part is rotatably connected to the stool plate or the stool leg, and the second rotary connecting part is rotatably connected to the pin.

Furthermore, the folding locking mechanism further includes a handle assembled on the pin.

Furthermore, the folding locking mechanism further includes a handle assembled on the pin and extending outwards out of the cross stopper.

Furthermore, the second connecting piece includes a reference face, a first side face and a second side face, wherein the second side face is fixedly connected to the reference face, the first side face is fixedly connected to the reference face or the second side face, stool leg is rectangular, the reference face and the second side face are separately attached to two adjacent side faces of the stool leg, and the first side face is attached to an end face of the stool leg.

Furthermore, the folding locking mechanism further includes a supporting piece, wherein the supporting piece includes a reference strip and a supporting strip, and the reference strip is fixedly connected to the supporting strip, the reference strip is fixedly connected to the stool plate; and when the step stool is used, the stool leg is unfolded, and the supporting strip abuts against the first side face.

Furthermore, the stool plate is provided with a through hole.

Compared with the prior art, the invention has the following advantages and effects: the step stool is of a folding structure and is small in size when folded, thereby being convenient to transport, and the stool legs can be locked by the locking mechanism when unfolded or folded, so that the safety in use is improved, and operation is convenient.

DETAILED DESCRIPTION OF THE EMBODIMENTS

The invention is further expounded below with reference to the accompanying drawings and embodiments. The following embodiments are used to explain the invention, but are not intended to limit the invention.

Embodiment 1

Figure 1:
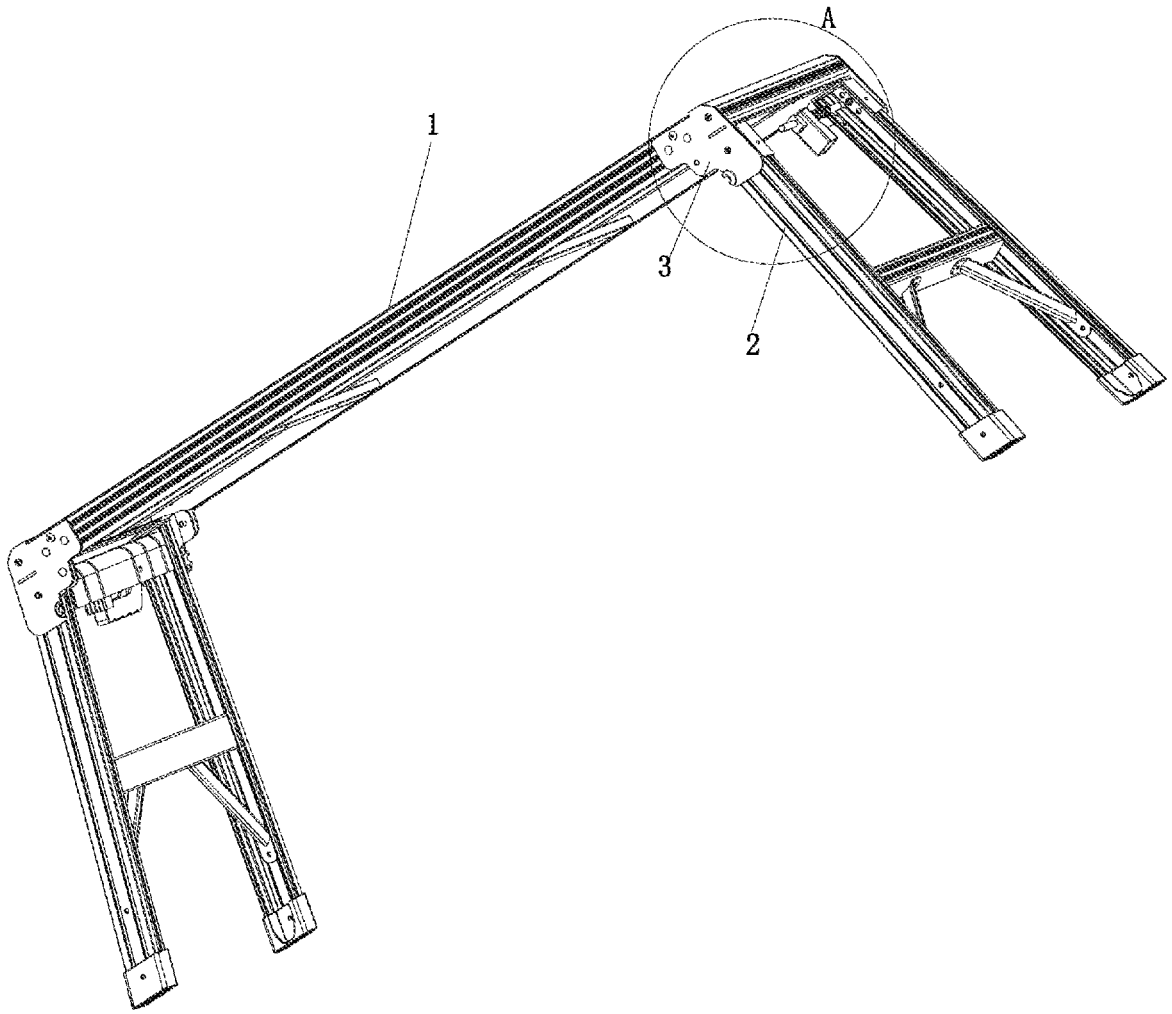
FIG. 1 is a structural view of a specific implementation of the invention.
Figure 2:
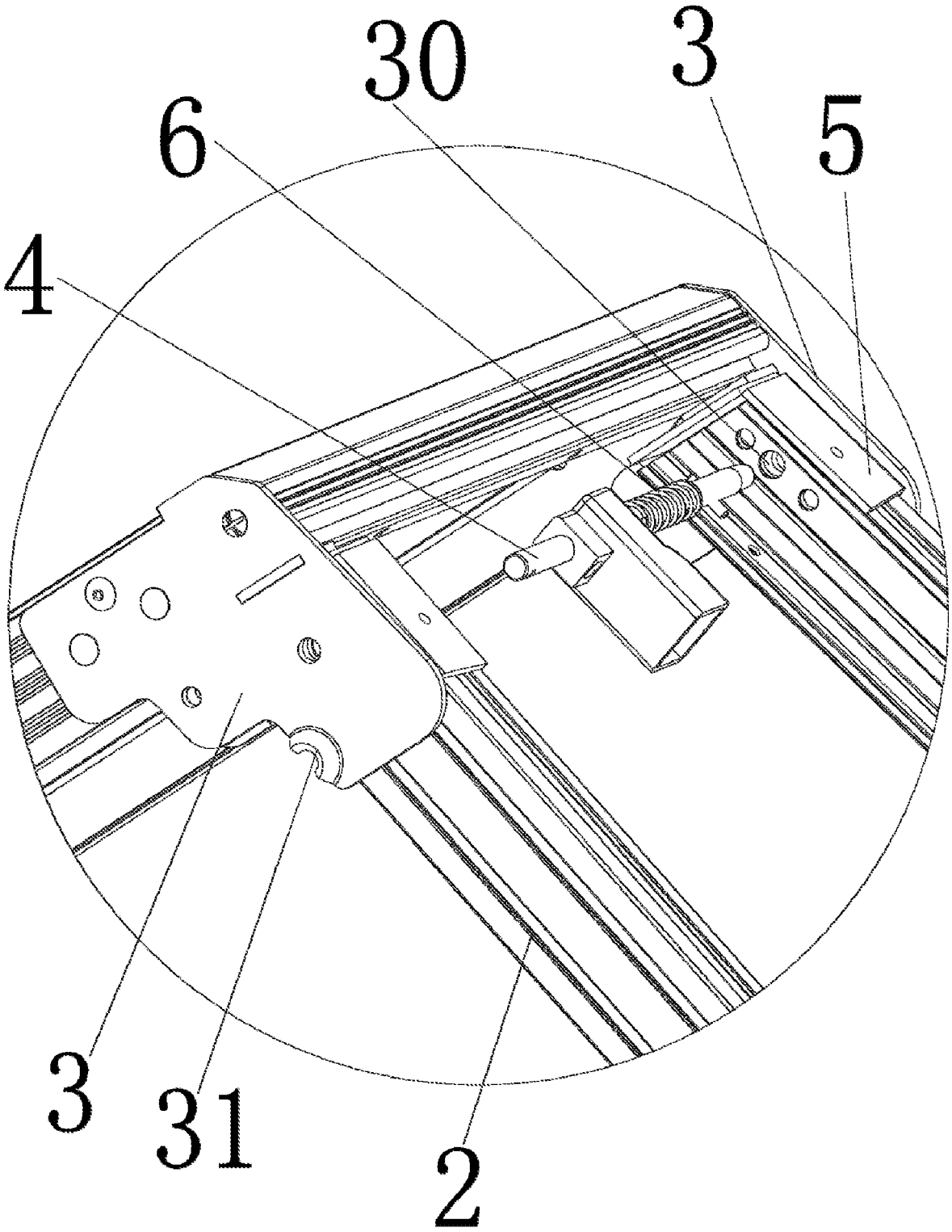
FIG. 2 is an enlarged view of part A in FIG. 1.
Figure 3:
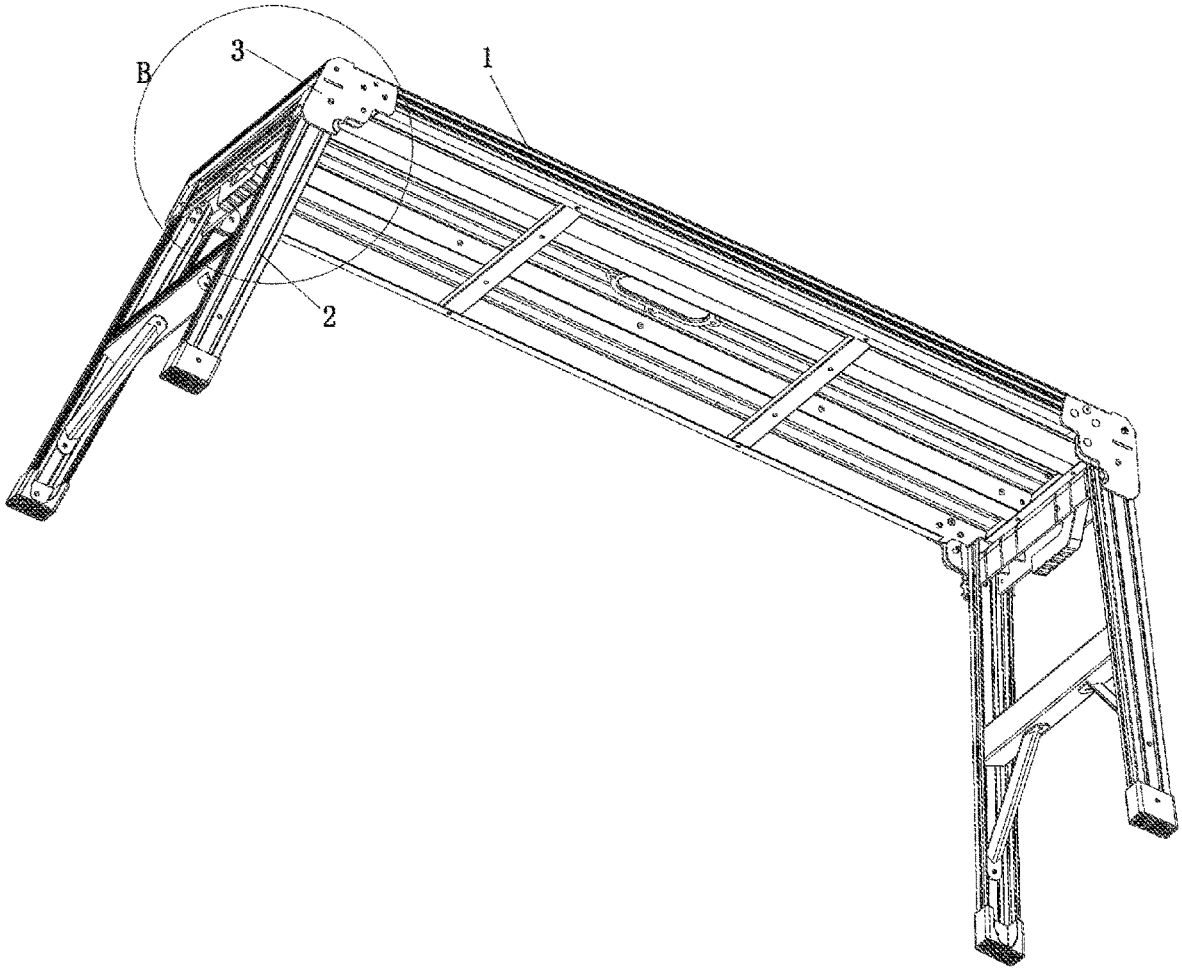
FIG. 3 is a structural view of the specific implementation of the invention under the condition that a spanner is included.
Figure 4:
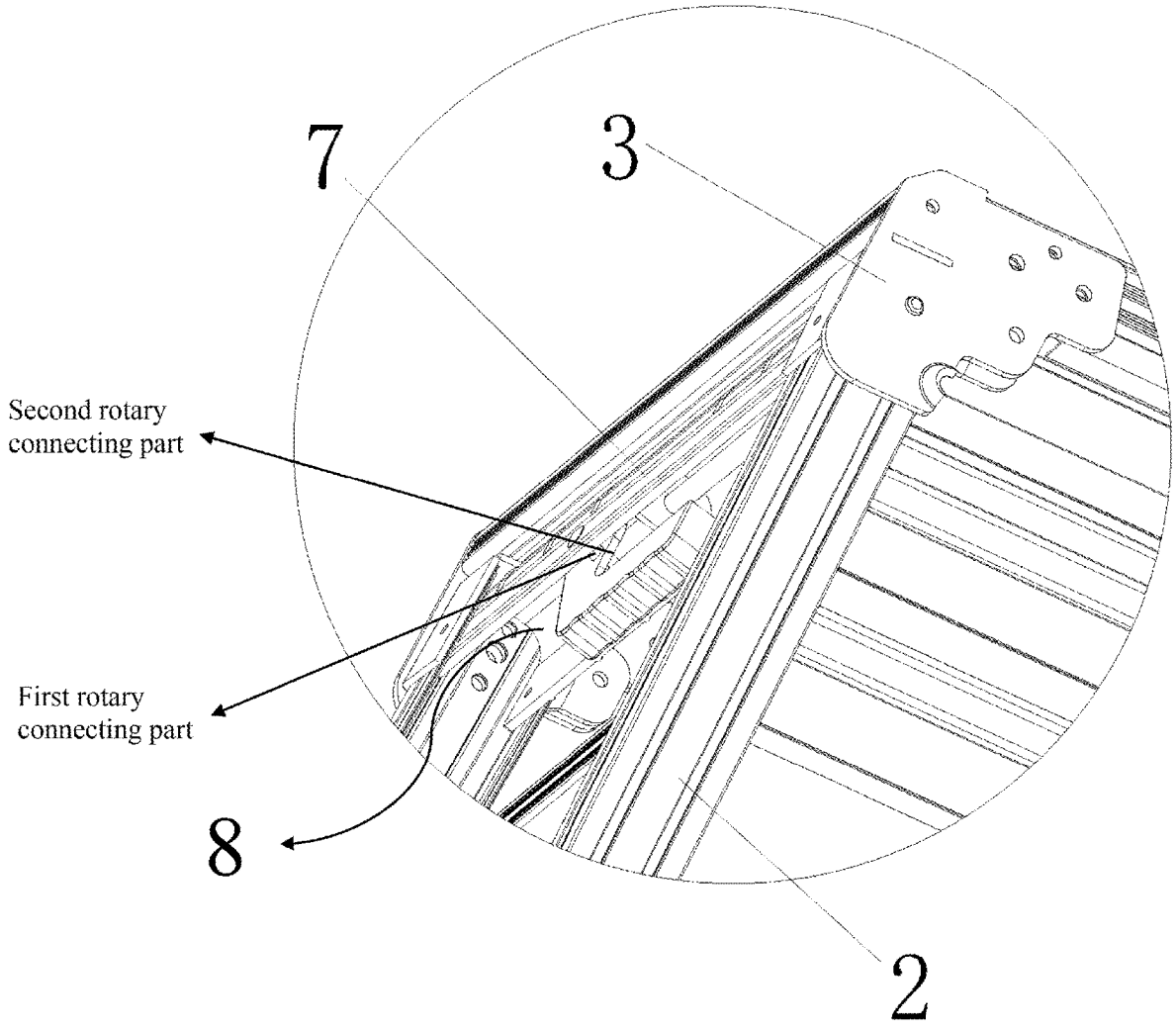
FIG. 4 is an enlarged view of part B in FIG. 3.
Figure 5:
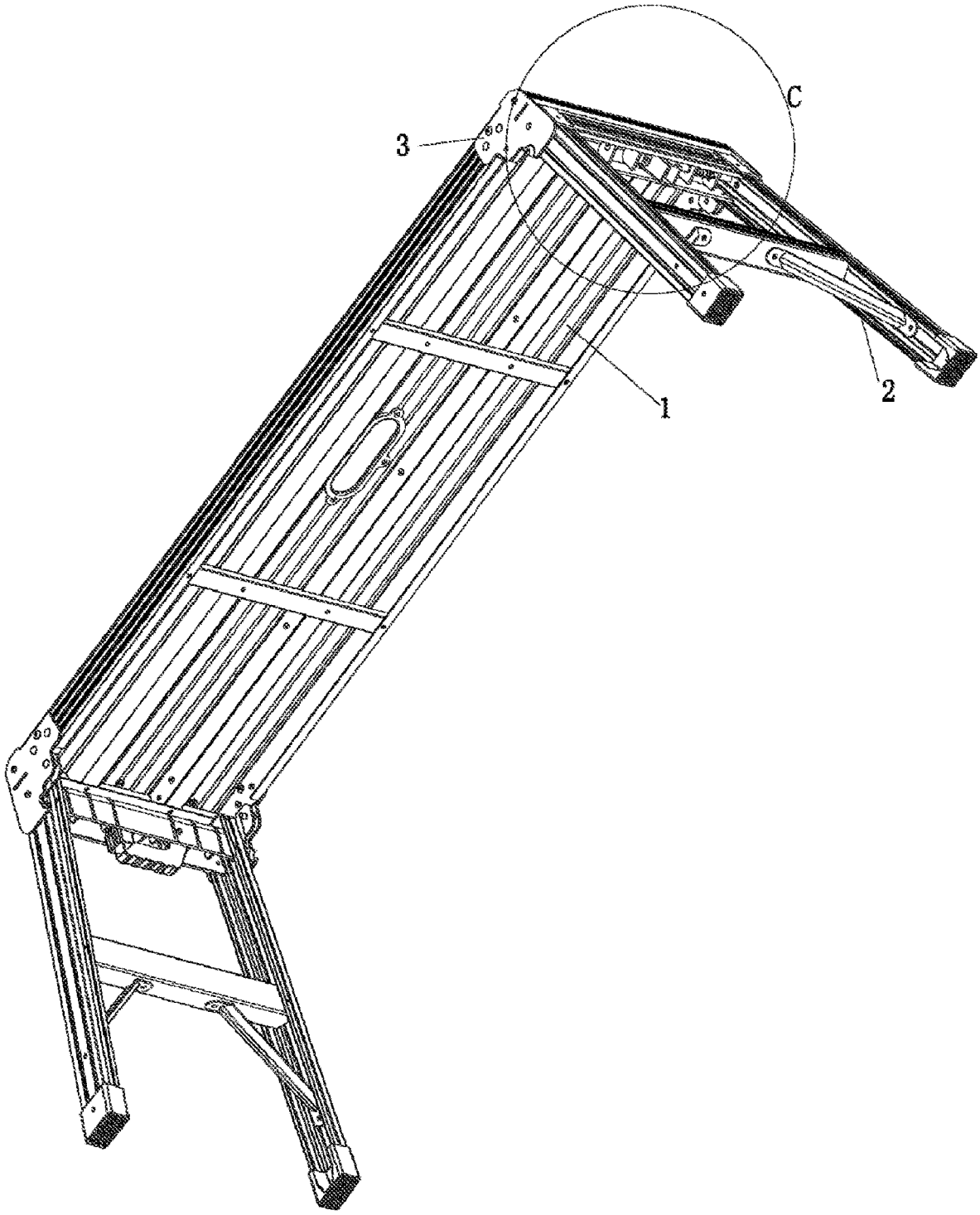
FIG. 5 is a structural view of the specific implementation of the invention under the condition that a handle is included.
Figure 6:
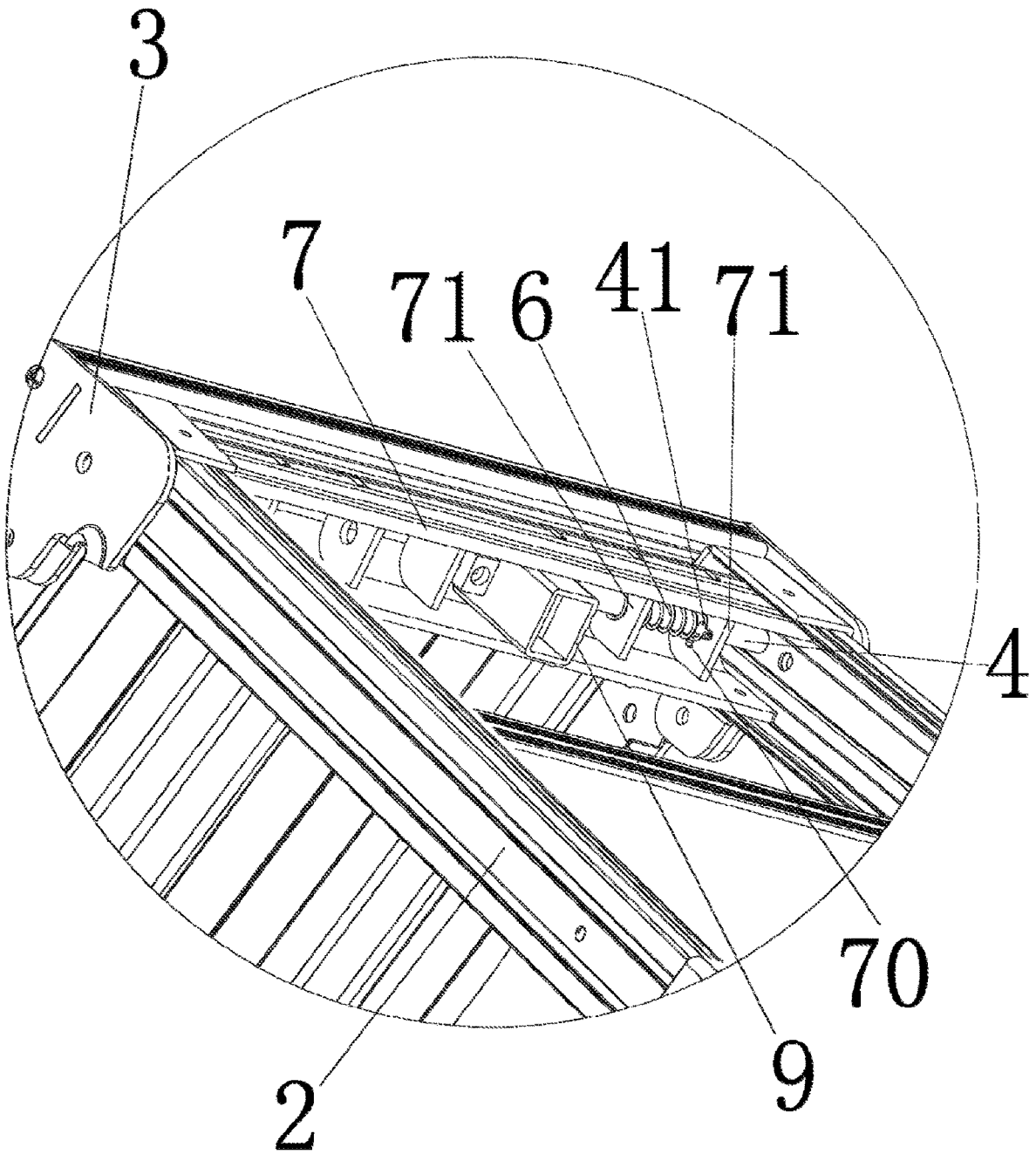
FIG. 6 is an enlarged view of part C in FIG. 3.
Figure 7:
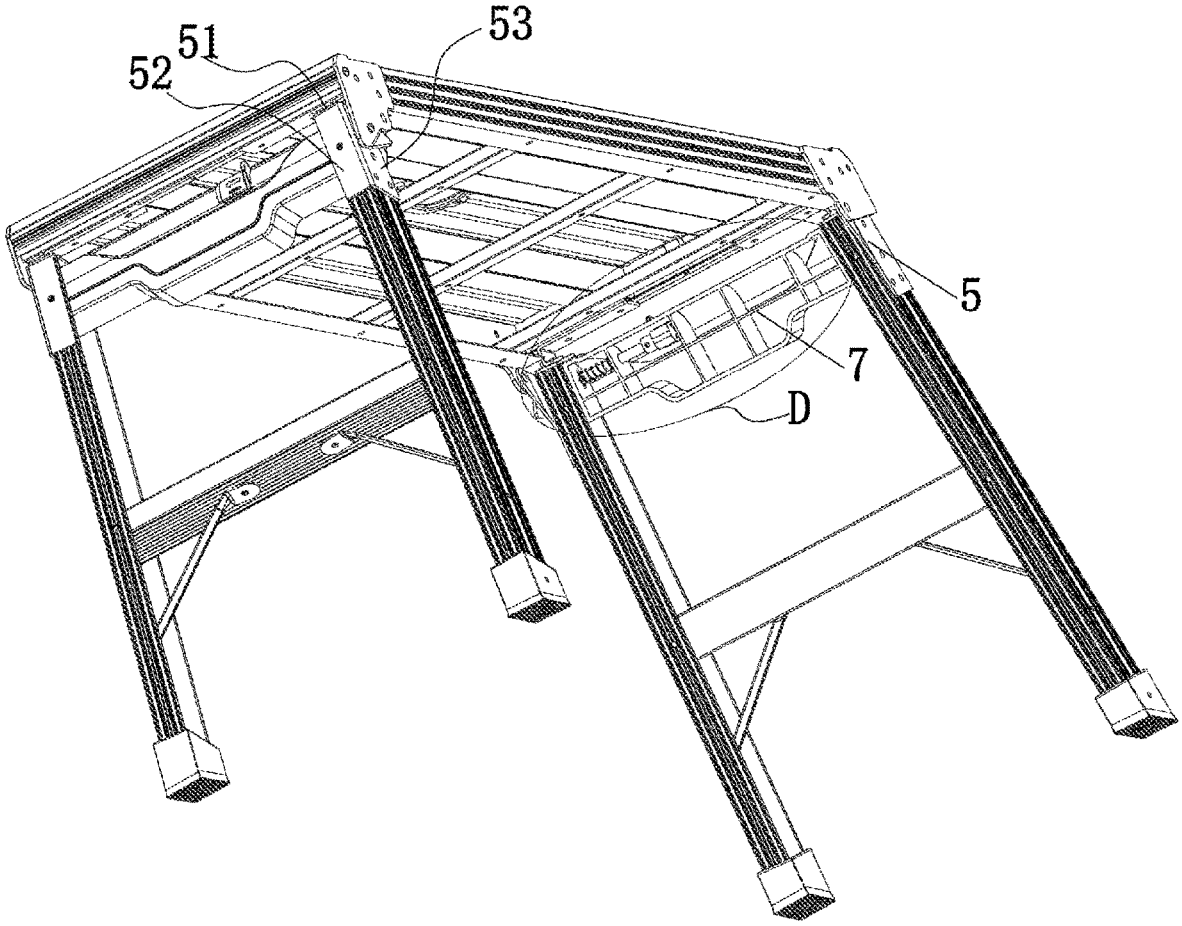
FIG. 7 is a structural view of another specific implementation of the invention.
Figure 8:
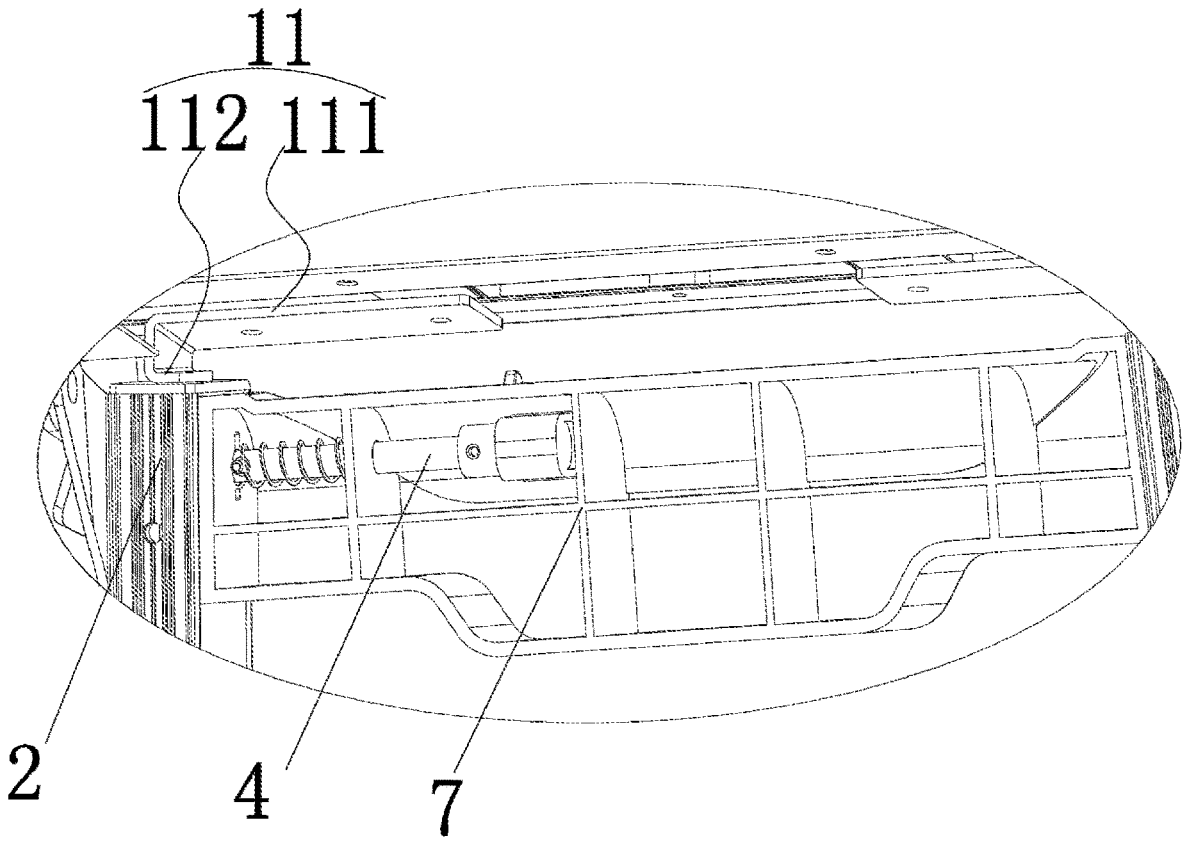
FIG. 8 is an enlarged view of part D in FIG. 3.
Figure 9:
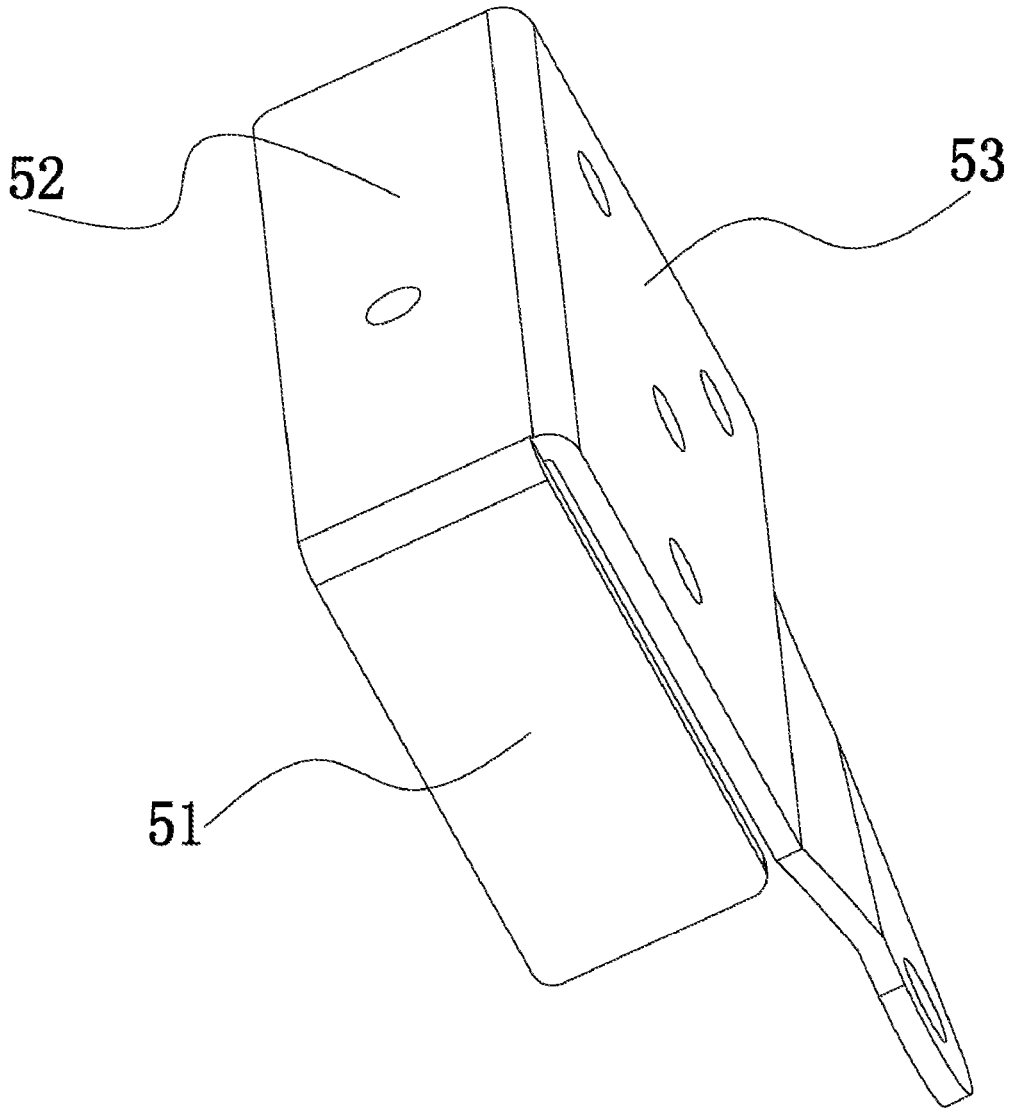
FIG. 9 is a structural view of a second connecting piece of the invention.

As shown in FIGS. 1-9, in this embodiment of the folding locking mechanism used for a step stool, the step stool includes a stool plate 1 and stool legs 2, wherein the stool legs 2 are rotatably arranged on the stool plate 1. In this embodiment, the folding locking mechanism includes a first connecting piece 3 and a pin 4, wherein the first connecting piece 3 is fixedly connected to the stool plate 1 and is provided with a limiting hole 30 allowing the pin 4 to fall therein, and the pin 4 is limited in the radial direction and is movable in the axial direction, relative to the stool leg 2. In one specific implementation, the stool leg 2 is provided with a through hole allowing the pin 4 to penetrate through, the pin 4 is arranged in the through hole, is limited by the through hole in the radial direction and is movable in the axial direction, and the pin 4 is located in the through hole and the limiting hole 30 at the same time, so that the stool leg 2 is locked.

In this embodiment, the folding locking mechanism further includes a second connecting piece 5 fixedly connected to the stool leg 2, wherein the second connecting piece 5 is rotatably connected to the first connecting piece 3. The second connecting piece 5 can increase the wall thickness of the stool legs 2, and thus, the stool legs 2 are rotatably connected to the stool plate 1 more stably.

In this embodiment, the folding locking mechanism further includes an elastic piece 6, wherein the elastic piece 6 is connected to the pin 4 and applies a force towards the limiting hole 30 to the pin 4. In the normal state, the pin 4 has a tendency to lock the stool leg 2, and thus, the locking safety is improved.

In this embodiment, a guide surface 31 extending outwards is arranged on an outer edge of the first connecting piece 3. 'Outwards' referred in this technical characteristic is a direction away from the stool plate 1, and the guide surface 31 extends outwards relative to the first connecting piece 3. When the stool leg 2 in a folded state is switched to a service state, the pin 4 first abuts against the guide surface 31 extending outwards, then abuts against the first connecting piece 3 and finally moves into the limiting hole 30 to achieve automatic locking. Preferably, the guide surface 31 and the first connecting piece 3 are of an integrated structure, and the guide surface 31 is machined while the first connecting piece 3 is manufactured.

The folding locking mechanism in this embodiment further includes a cross stopper 7 used for mounting the pin 4, wherein the cross stopper 7 is connected to the stool leg 2, the cross stopper 7 is provided with two stop pieces 71, the stop pieces 71 are provided with holes allowing the pin 4 to penetrate through, a gap is reserved between the two stop pieces 71, and the elastic piece 6 is arranged between the two stop pieces 71 and has an end abutting against the stop pieces 71 and an end abutting against a pin shaft 41 on the pin 4. The pin shaft 41 is fixedly connected to the pin 4. The holes are provided with openings 71 allowing the pin shaft 41 to penetrate through, and after the pin is assembled with the cross stopper and the pin shaft, the pin shaft 41 is mismatched with the openings 70. When the folding locking mechanism is assembled, the elastic piece 6 is a spring, the pin shaft 41 is fixed to the pin shaft first, the spring is arranged between the two stop pieces 71, the pin 4 rotates to make the pin shaft 41 correspond to the openings 70, and after the pin shaft 41 moves to abut against the spring, the pin 4 rotates to make the pin shaft 41 mismatched with the openings 70, so that assembling is completed. The folding locking mechanism has the advantages of being easy and fast to assemble, and the like. The pin shaft 41 does not need to overcome an elastic force when assembled.

In this embodiment, the folding locking mechanism further includes a spanner 8, wherein the spanner 8 is provided with a first rotary connecting part and a second rotary connecting part, the first rotary connecting part is rotatably connected to the stool plate 1 or the stool leg 2, and the second rotary connecting part is rotatably connected to the pin 4. In this embodiment, rotary connection includes, but is not limited to, hinged connection and also includes rotary connection after face-to-face abutting.

In this embodiment, the folding locking mechanism further includes a handle 9, wherein the handle 9 is assembled on the pin 4. Generally, the handle 9 intersects with the pin 4 in the movable direction, so that the folding locking mechanism has the advantage of being easy to operate.

In this embodiment, the handle 9 can also be assembled in another way, particularly, the handle 9 is assembled on the pin 4 and penetrates through the cross stopper 7 to extend outwards out of the cross stopper 7.

In this embodiment, the second connecting piece 5 includes a first side face 51, a second side face 52 and a reference face 53, wherein the second side face 52 is fixedly connected to the reference face 53, and the first side face 51 is fixedly connected to the second side face 52 or the reference face 53; the stool leg 2 is rectangular, and preferably, every two of the reference face 53, the first side face 51 and the second side face 52 are perpendicular to each other; the reference face 53 and the second side face 52 are separately attached to two adjacent side faces of the stool leg 2, and the first side face 51 is attached to an end face of the stool leg 2. Three sides of the stool leg 2 are surrounded by the connecting piece 5, so that the stool leg 2 is reinforced by the second connecting piece 5, and the second connecting piece 5 is connected to the stool leg 2 more stably.

In this embodiment, the folding locking mechanism further includes a supporting piece 11, wherein the supporting piece 11 includes a reference strip 111 and a supporting strip 112, and the reference strip 111 is fixedly connected to the supporting strip 112. Preferably, the reference strip 111 is parallel to the extension direction of the supporting strip 112, and the reference strip 111 is fixedly connected to the stool plate 1. When the step stool is used, the stool leg 2 is unfolded, and the supporting strip 112 abuts against the first side face 51. Preferably, the supporting piece 11 is made from steel and is a U-shaped hook bent from a steel bar and having a long edge serving as the reference strip 111 and a short edge serving as the supporting strip 112, so that the structural strength is good. When the step stool is used, a force applied to the supporting strip 112 by the stool leg 2 is borne and dispersed by the supporting piece 11, and thus, compared with a configuration that the stool leg 2 directly abuts against the step stool, the durability is greatly improved.

Furthermore, the stool plate 1 is provided with a through hole, and users can stretch the hand into the through hole to conveniently carry the step stool.

The embodiments described in the specification are only illustrative ones of the invention. Various modifications, supplements or similar substitutes of these specific embodiments made by those skilled in this field without deviating from the contents in the specification or going beyond the scope defined by the claims should also fall within the protection scope of the invention.

What is claimed is:

1. A folding locking mechanism for use in combination with a step stool, wherein the step stool includes a stool plate and stool legs rotatably arranged on the stool plate, the folding locking mechanism comprising a first connecting piece, an elastic piece and a pin, wherein the first connecting piece is to fixedly connect to the stool plate and is provided with a limiting hole;

the elastic piece is connected to the pin and urges the pin in a direction toward the limiting hole, the pin is fallen in the limiting hole, and the pin is limited in a radial direction and is movable in an axial direction relative to the stool legs, a cross stopper configured for assembling the pin; is provided with two stop pieces;

the stop pieces are provided with holes;

the pin is allowed to penetrate through the holes;

a gap is reserved between the two stop pieces;

the elastic piece is arranged between the two stop pieces;

a first end of the elastic piece abuts against the stop pieces; and an second end of the elastic piece abuts a pin shaft on the pin, wherein the holes are provided with openings; the pin shaft penetrates through the openings; and after the pin is assembled with the cross stopper and the pin shaft, the pin shaft is mismatched with the openings.

2. The folding locking mechanism according to claim 1, wherein the folding locking mechanism further comprises a second connecting piece to fixedly connect to at least one of the stool legs, and the second connecting piece is rotatably connected to the first connecting piece.

3. The folding locking mechanism according to claim 1, wherein a guide surface extending outwards is arranged on an outer edge of the first connecting piece.

4. The folding locking mechanism according to claim 1, wherein the folding locking mechanism further comprises a spanner; the spanner is provided with a first rotary connecting part and a second rotary connecting part; the first rotary connecting part is rotatably connected to the stool plate or to the at least one of the stool legs; and the second rotary connecting part is rotatably connected to the pin.

5. The folding locking mechanism according to claim 1, wherein the folding locking mechanism further comprises a handle assembled on the pin.

6. The folding locking mechanism according to claim 3, wherein the folding locking mechanism further comprises a handle assembled on the pin.

7. The folding locking mechanism according to claim 2, wherein the folding locking mechanism further comprises a handle assembled on the pin; and the handle extends outwards out of the cross stopper.

8. The folding locking mechanism according to claim 2, wherein the second connecting piece comprises a reference face, a first side face and a second side face;

the second side face is fixedly connected to the reference face;

the first side face is fixedly connected to the reference face or the second side face.

9. The folding locking mechanism according to claim 8, wherein the folding locking mechanism further comprises a supporting piece;

the supporting piece comprises a reference strip and a supporting strip;

the reference strip is fixedly connected to the supporting strip.

10. The folding locking mechanism according to claim 2, wherein a guide surface extending outwards is arranged on an outer edge of the first connecting piece.

11. The folding locking mechanism according to claim 2, wherein the folding locking mechanism further comprises a spanner; the spanner is provided with a first rotary connecting part and a second rotary connecting part; the first rotary connecting part is rotatably connected to the stool plate or to the at least one of the stool legs; and the second rotary connecting part is rotatably connected to the pin.

12. The folding locking mechanism according to claim 8, wherein the folding locking mechanism further comprises a handle assembled on the pin.

13. The folding locking mechanism according to claim 10, wherein the folding locking mechanism further comprises a handle assembled on the pin; and the handle extends outwards out of the cross stopper.

14. The folding locking mechanism according to claim 1, wherein the folding locking mechanism is operably connected to a stool having a stool plate and stool legs rotatably arranged on the stool plate.

* * * * *